US005784818A

United States Patent [19]

Otteson

[11] Patent Number: 5,784,818

[45] Date of Patent: Jul. 28, 1998

[54] FIREARM HAVING A FIRE CONTROL SAFETY

[76] Inventor: N. Stuart Otteson, 1705 Dogwood Dr., Alexandria, Va. 22302

[21] Appl. No.: 681,555

[22] Filed: Jul. 23, 1996

Related U.S. Application Data

[60] Provisional application No. 60/001,882 Aug. 3, 1993.

[51] Int. Cl. [6] ..... F41A 17/00

[52] U.S. Cl. ..... 42/70.04; 42/70.05; 42/70.01

[58] Field of Search ..... 42/70.04, 70.05, 42/70.07, 70.11, 70.01

[56] References Cited

U.S. PATENT DOCUMENTS

| | | | |
|---|---|---|---|
| 834,772 | 10/1906 | Tamour | 42/70.04 |
| 2,189,202 | 2/1940 | Garland | 42/70.05 |
| 2,926,447 | 3/1960 | Scripter | 42/70.04 |
| 3,128,570 | 4/1964 | Browning | 42/70.04 |
| 3,608,224 | 9/1971 | Hildebrandt | 42/70.05 |
| 3,706,152 | 12/1972 | Wilhelm | 42/70.04 |
| 3,747,251 | 7/1973 | Baker | 42/70.04 |
| 3,949,508 | 4/1976 | Elkas | 42/70.04 |
| 4,305,218 | 12/1981 | Godsey | 42/70.01 |
| 5,025,582 | 6/1991 | Mote, Sr. | 42/70.06 |
| 5,109,622 | 5/1992 | Echeberria | 42/70.04 |
| 5,287,642 | 2/1994 | Scaramucci | 42/70.08 |
| 5,417,001 | 5/1995 | Rousseau | 42/70.01 |

FOREIGN PATENT DOCUMENTS

| | | | |
|---|---|---|---|
| 371455 | 3/1923 | Germany | 42/70.04 |

*Primary Examiner*—Charles T. Jordan
*Assistant Examiner*—Theresa M. Wesson

[57] ABSTRACT

Means to prevent a firearm from accidentally discharging during the process of releasing the safety mechanism, such prevention of accidental discharge being accomplished by preventing or rendering less probable one or more of the following: 1) a trigger being unintentionally pressed back, 2) an unintentionally pressed-back trigger being displaced, and 3) an unintentionally displaced trigger releasing the firing pin.

3 Claims, 10 Drawing Sheets

FIREARM HAVING A FIRE CONTROL SAFETY

Continuity Information: The invention set forth herein was previously set forth in provisional application Ser. No. 60/001,882 dated Aug. 3, 1995.

BACKGROUND OF THE INVENTION

The status of the spring-powered firing pin of a firearm which is in the ready-to-fire condition is governed by the "fire control," a term describing the combination of a trigger mechanism and a safety mechanism. When such a firing pin is releasably constrained by a trigger mechanism, a properly operated safety mechanism can be in one of three circumstances: 1) engaged, 2) in transition between engaged and disengaged, and 3) disengaged. The fire controls in many existing firearms lack a high degree of certainty (against accidental discharge) when the safety mechanism is being released (i.e., in the process of being transferred between the engaged and the disengaged position).

Safety mechanisms applied to 19th century bolt action firearms were often not convenient to operate, convenience of operation being defined as the ability of the shooter to quickly and easily disengage the safety mechanism while maintaining an effective grip on the firearm with the right hand (for convenience, assuming here, and elsewhere in this disclosure, a right-handed shooter). By the middle of the 20th century, with the major usage of bolt action firearms shifted from military to civilian, convenience of operation of the safety mechanism became an overriding marketing consideration. Whereas military bolt action firearms often had safety mechanisms which required the complete repositioning of the right hand in order to actuate the safety means (hereinafter referred to for convenience also as the safety lever or the finger lever), modern commercial bolt action firearms have employed convenient safety mechanisms wherein the right hand retains an effective grip on the firearm while the safety is disengaged by a movement of the right thumb.

While convenient, this thumb operation also allows the shooter's trigger finger (right-hand forefinger) to reside inside the trigger bow, and even rest against the trigger, during the process of disengaging the safety lever. Further, a forward movement of the right thumb in disengaging the safety mechansim can result in an unintended rearward reaction of the trigger finger. This is a concern with any type of safety mechanism, and can be especially significant where the safety mechanism has cammed and blocked either the firing pin or sear, since freeing the trigger piece of mainspring load can render it particularly vulnerable to accidental displacement.

Further, in a safety mechanism which cams and blocks the firing pin or sear, there has heretofore been no effective means to verify or ensure that the trigger piece is waiting in correct postion to resume control when the safety mechanism is disengaged. Thus, if for any one of a number of possible reasons, including even the operator inadvertently pulling on it, the trigger piece is out of position to accept and support the sear when the safety mechanism is moved from the engaged to the disengaged position, that disengaging movement can simply drop the sear, allowing the firearm to accidentally discharge.

SUMMARY OF THE INVENTION

The present invention allows an optimal degree of certainty against unintended discharge when the safety mechanism is in transition from the engaged to the disengaged position. This optimal degree of certainty is made possible by: 1) a novel placement of the safety mechanism actuating means, 2) a novel immobilization of the trigger mechanism actuating means, and 3) a novel fail-safe backup means. The incorporation of one or more aspect of this invention will enhance the margin of safety of any fire control design. The incorporation of all aspects of this invention will provide the highest possible margin of certainty, well above that ever previously attainable in a firearm.

The principles set forth in the present invention are of such a nature as to allow a firearms manufacturer to incorporate as much or as little margin of certainty as is deemed appropriate for any particular firearm, based on type and intended usage. For example, the fire control of a firearm built for target work under strict range handling rules may not necessarily require the same margin of certainty as one intended for hunting in difficult terrain and subject to rough handling.

The unique placement of the safety mechanism actuating means embodied in the present invention is applicable to all classes and types of firearms, including both muzzle-loading and breech-loading types, but for convenience and clarity is described and illustrated herein with specific reference to a bolt action firearm which utilizes a safety mechanism which cams and blocks the sear. Yet it can be applied equally well to a safety mechanism which cams and blocks the firing pin, as well as a safety mechanism which blocks the trigger ("trigger-block" type safety).

The present invention locates the safety mechanism actuating means where it can provide convenient operation while at the same time guard against carelessness on the part of the shooter by ensuring that the trigger finger is not touching the trigger as the safety mechanism is being released. The safety mechanism actuating means of the present invention operates in a fore and aft manner above the trigger guard bow in a location that compels the complete removal of the trigger finger from the trigger guard bow in order to actuate. Neither the thumb, nor any of the other fingers of the right hand, can be utilized to actuate a safety lever so located without at the same time relinquishing an effective grip by the right hand on the firearm. No other safety operating in a fore and aft manner has allowed the maintenance of an effective grip on the firearm while at the same time has compelled the removal of the trigger finger from the vicinity of the trigger as the safety mechanism is being disengaged.

The location of the finger lever above the trigger bow, and its fore and aft operation, in the present invention allows the maximum application of force by the trigger finger, equivalent to that available from the thumb. Operating levers located in the forward web of the trigger guard bow for lateral displacement by way of the finger tip do not facilitate the application of sufficient force to operate a cam and block type of safety mechanism. Those located inside the trigger bow have likewise not allowed the application of effective finger leverage, plus they have failed to require the removal of the trigger finger from inside the trigger bow during their actuation.

The location in the present invention of the finger lever in the zone under the bolt handle when applied to a bolt action firearm can in addition afford protection against an inadvertent shifting of its assigned position due to contact with things such as twigs, branches, saddle scabbards, heavy outer wear, and foul-weather gear, a protection which thumb-operated safety mechanisms do not provide. It is also an ideal location from a visual and tactile standpoint, offering effective status determination and actuation even under adverse conditions of weather or light.

The fore and aft movement of the finger lever in the present invention conforms to the traditional safety mechanism operating pattern that has been ingrained as second nature into generations of users of commercial firearms. The basic pattern of forward to fire and aft to safe is so thoroughly ingrained, in fact, that deviations from it may, in and of themselves, constitute safety hazards.

The fore and aft finger lever movement in the present invention allows a generous total operating movement, substantially greater than the total operating movement found in thumb-operated safety mechanisms, both of the rear tang and the side-rocker varieties. The advantages of this available extra movement are that it can: 1) avoid ambiguous finger lever positioning, 2) allow a powerful internal leverage system for large and optimal displacements of the working parts of the fire control, and 3) facilitate an immobilization of the trigger piece.

Where either the sear or the firing pin is cammed and blocked, thus freeing the trigger piece from mainspring load, it is desirable to immobilize the trigger piece. This helps avoid opportunities, no matter how remote, for the trigger piece to inadvertently end up in a displaced condition either when the safety is engaged or during the process of releasing the safety mechanism. Further, such immobilization can satisfy shooter perception, many shooters not being comfortable if the trigger has an aspect of free movement when the safety mechanism is engaged.

To satisfy this perception, it is not necessary to block the trigger piece with complete rigidity. It is preferable, in fact, to block the trigger with a complete lack of free play (which due to normal manufacturing and assembly tolerances, would not be compatible with a completely rigid block, as is understood by those skilled in the art). Thus, in the present invention the trigger can be immobilized in a non-rigid manner without free play.

Both the camming of the sear (or firing pin) and the blocking of the trigger piece can utilize low-friction members such as rollers to minimize the level of operating effort required to be applied to the finger lever.

It is desirable to positively detent the finger lever in its assigned positions, eliminating any possibility of "parking" it, either inadvertently or intentionally, in any intermediate or ambiguous position. It is also desirable for all parts of a fire control to be inertially balanced for resistance against externally-imposed impacts. But these attributes are not specific to the present invention, and the necessary detent means or the necessary proportioning of parts for inertial balance, are not indicated on the drawings, nor further discussed herein.

The safety in the present invention is shown operating as a simple fore and aft two-position mechanism (fore to fire, aft to safe). Such two-position on-off operation is instinctive to users of firearms. It is the most traditional and effective safety actuation pattern ever developed for firearms, avoiding the complexity and ambiguity of safety mechanisms with a greater number of positions. A safety mechanism in accordance with the present invention when applied to a breech-loading firearm can also employ a means to lock the breech bolt closed when the safety is engaged, an attribute which has proven necessary for reliable operation of a firearm by guarding against misfires from partially opened breech bolts, and even the loss of cartridges from the inadvertent opening of the breech bolt during handling under adverse field conditions. The breech bolt lock can also provide a safe and reliable means to verify the status of the safety, for example by testing or pulling upward on the bolt handle of a bolt action firearm, thus avoiding any temptation to attempt verification in a less safe manner. Breech bolt locks are thus highly desirable and are used in many commercial firearms.

A breech bolt lock release is highly desirable to allow the above mentioned simple and unambiguous two-position safety actuation pattern, and the reliable bolt lock, to be combined with the capability of opening the breech bolt with the safety engaged. Breech bolt lock release mechanisms have been embodied in several commercial firearms. Since the construction and operation of the breech bolt lock and the breech bolt lock release are both well known to those skilled in the art, and to avoid unnecessarily crowding or obscuring the drawings, such devices will not be illustrated in the drawings, nor further discussed hereinafter.

To ensure optimal function and a solid quality feel, the safety finger lever in the present invention can be incorporated into the fire control housing. Therefore, to allow stock removal in a customary and convenient manner, the fire control housing can be attached to the receiver by means of vertically-acting fastening means, and the trigger bow can be attached to, or integral with, the fire control housing, or can be attached in the more usual manner directly to the receiver or stock. In this way, stock removal does not require any disassembly of the fire control unit.

The safety means of the present invention can be structurally symmetrical, so that not only are unbalanced force vectors avoided, but right or left-hand operation can be accommodated.

The present invention also embodies a fail-safe backup means. It is applicable to all classes and types of firearms which utilize a safety mechanism which cams and blocks the firing pin or sear, but for convenience and clarity is illustrated with specific reference to a commercial bolt action firearm.

It is the purpose of the fail-safe backup means to prevent the safety mechanism from disengaging unless the trigger piece is in position to accept and support the sear and firing pin. To ensure that under no possible circumstance can a safety mechanism inadvertently function as a trigger mechanism.

BRIEF DESCRIPTION OF THE DRAWINGS

In order to most clearly illustrate the principles involved in the present invention, and to avoid unnecessarily crowding or obscuring the drawings, various springs, stops, adjusting screws, and detent means associated with the construction and operation of a fire control, but not specific to the purposes of the present invention, and in any event well known to those skilled in the art, have been omitted.

FIG. 3 shows the relative position of the parts with the safety mechanism shifted rearward into the fully engaged position.

FIG. 4 shows the relative position of the parts with the safety mechanism shifted forward into the fully disengaged position.

FIG. 5 shows the relative position of the parts with the safety mechanism shifted forward from the engaged position toward the disengaged position, but the trigger piece not positioned to accept and support the sear.

FIG. 6 shows the relative position of the parts with the safety mechanism rotated rearward into the fully engaged position.

FIG. 7 shows the relative position of the parts with the safety mechanism rotated forward into the fully disengaged position.

FIG. 8 shows the relative position of the parts with the safety mechanism rotated forward from the engaged toward the disengaged position, but the trigger piece not positioned to accept and support the sear.

FIG. 9 shows the relative position of the parts with the safety mechanism rotated rearward into the fully engaged position.

FIG. 10 shows the relative position of the parts with the safety mechanism rotated forward into the fully disengaged position.

FIG. 11 shows the relative position of the parts with the safety mechanism rotated forward from the engaged toward the disengaged position, but the trigger piece not positioned to accept and support the sear.

DETAILED DESCRIPTION

Figure 1:
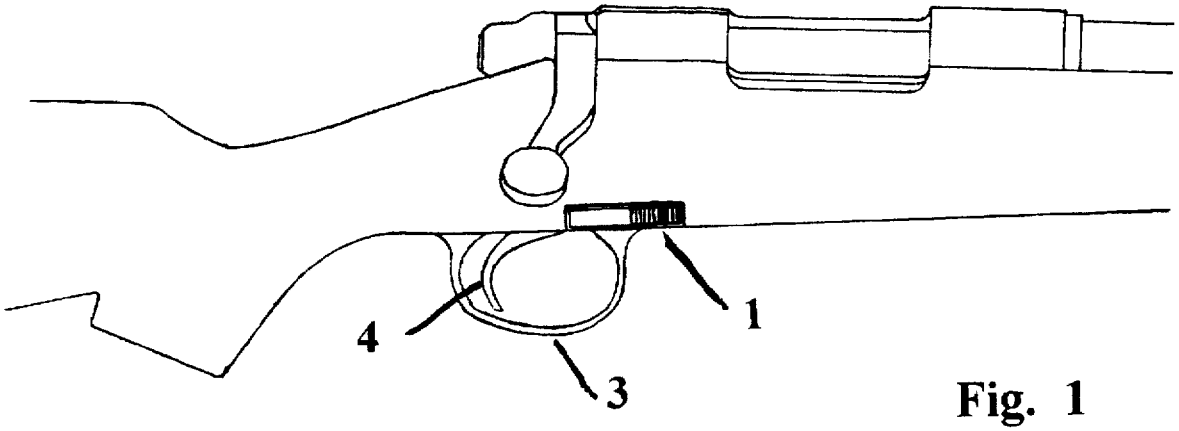
FIG. 1 illustrates an embodiment of the present invention applied to the exterior configuration of a commercial type bolt action firearm.
Figure 2:
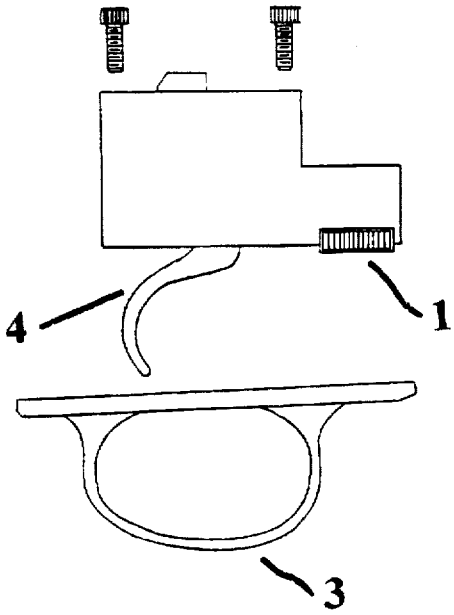
FIG. 2 illustrates an embodiment of the present invention applied to a fire control housing which is releasably secured by vertical means to the receiver of the firearm, and compatibly integrated with a trigger guard assembly.

FIG. 1 shows an embodiment of the present invention applied to the exterior configuration of a commercial type bolt action rifle. FIG. 2 shows a vertical attachment means for the housing of the fire control of the embodiment of the present invention shown in FIG. 1.

Figure 3:
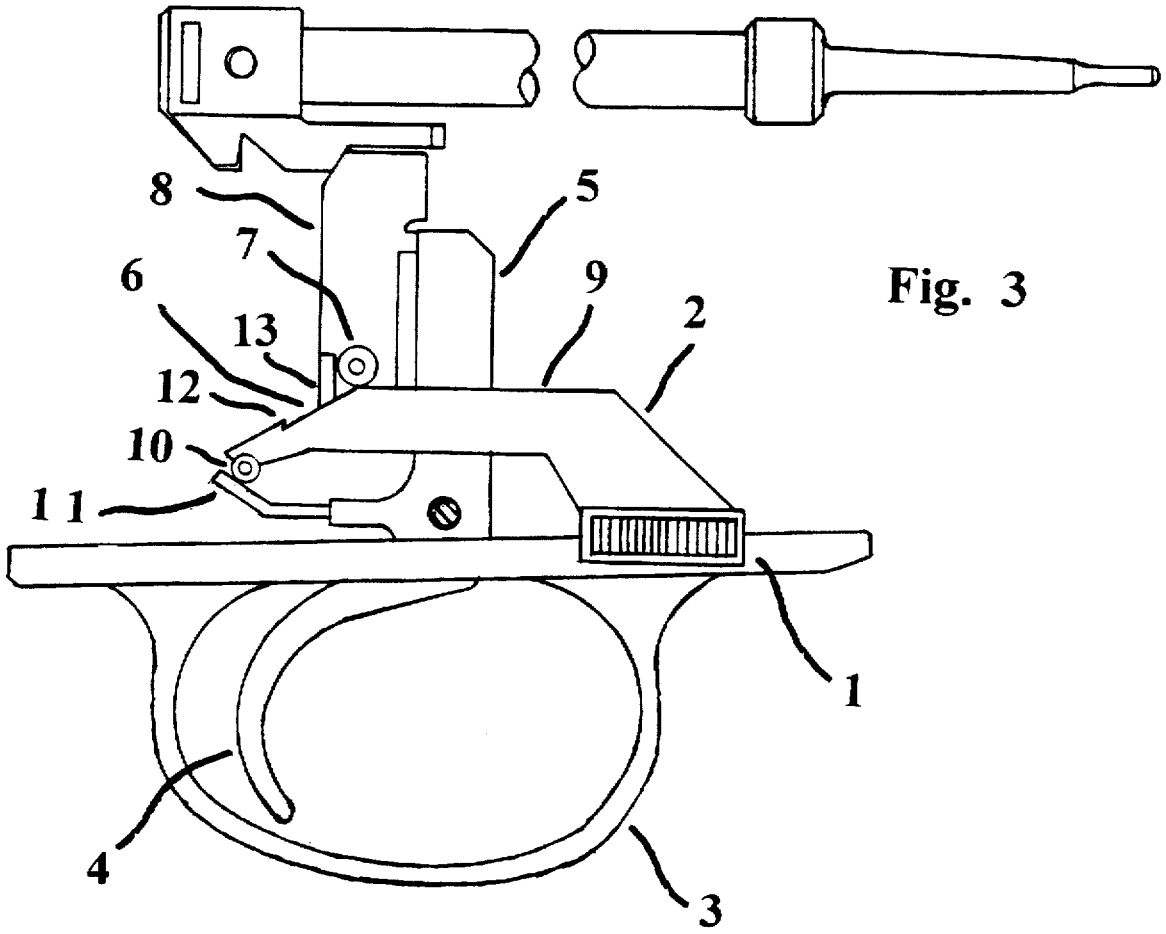
FIGS. 3 through 5 illustrates an embodiment of the present invention as applied to a fire control with a vertically sliding sear and a trigger-finger operated safety mechanism which cams and blocks the sear.

FIG. 3 shows an embodiment of the present invention with the finger lever (1) rearward so the safety mechanism (2) is in the engaged position. The shooter's trigger finger can be easily positioned above the trigger guard bow (3) and into contract with a knurled, ridged, or otherwise ergonomically engineered surface of the finger lever to move it to the disengaged position. This can be accomplished with equal ease and certainty whether the firearm is being carried afield, is being gripped in preparation to firing, or is being gripped in preparation to unloading. In each case, the trigger finger is removed from the proximity of the shoe portion (4) of the trigger piece (5), and from inside the trigger guard bow.

With the finger lever shifted rearward, a sloping means (6) will act against a projecting means, shown here as a roller (7), to cam a vertically disposed sear (8) upward free of supporting contact with the trigger piece. A non-sloping means (9) then positively blocks the sear from dropping down. Following this initial cam and block operation, a means, shown here as roller (10) connected to the safety mechanism, can contact a means (11) on the trigger piece in such a way that the trigger piece is immobilized with no free play that can be perceived by the shooter should he choose to test the trigger shoe with his finger after the safety mechanism has been engaged.

Figure 4:
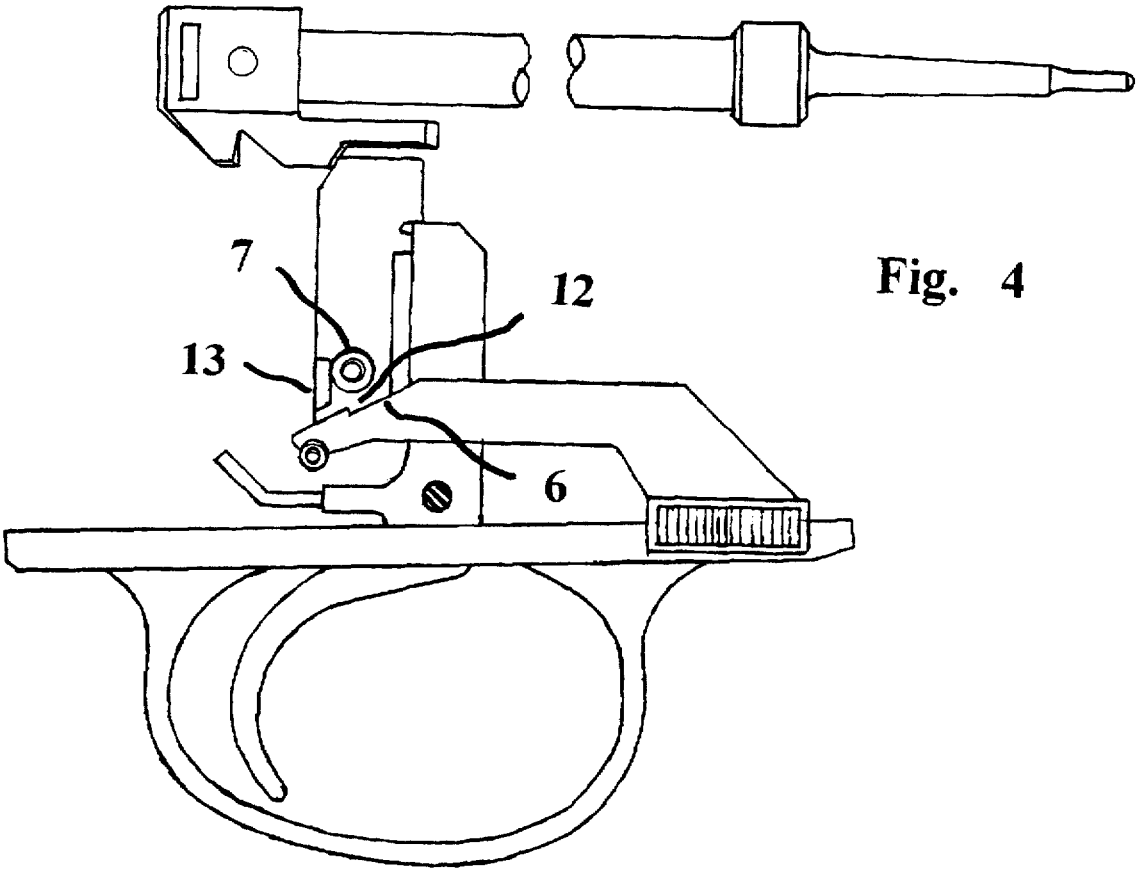

FIGS. 3 and 4, respectively, show the circumstances of the parts before and after the successful transfer of the sear from the control of the safety mechanism to the control of the trigger piece. After the trigger piece has picked up and arrested any further downward movement of the sear, surfaces (6) and (7), on the safety mechanism and sear, respectively, have immediately released contact and separated spatially during the remainder of the forward linear movement of the safety mechanism, as indicated in FIG. 4. Thus entrapping surfaces (12) and (13), on the safety mechanism and sear, respectively, do not engage and interfere with the complete release of the sear by the safety mechanism.

Figure 5:
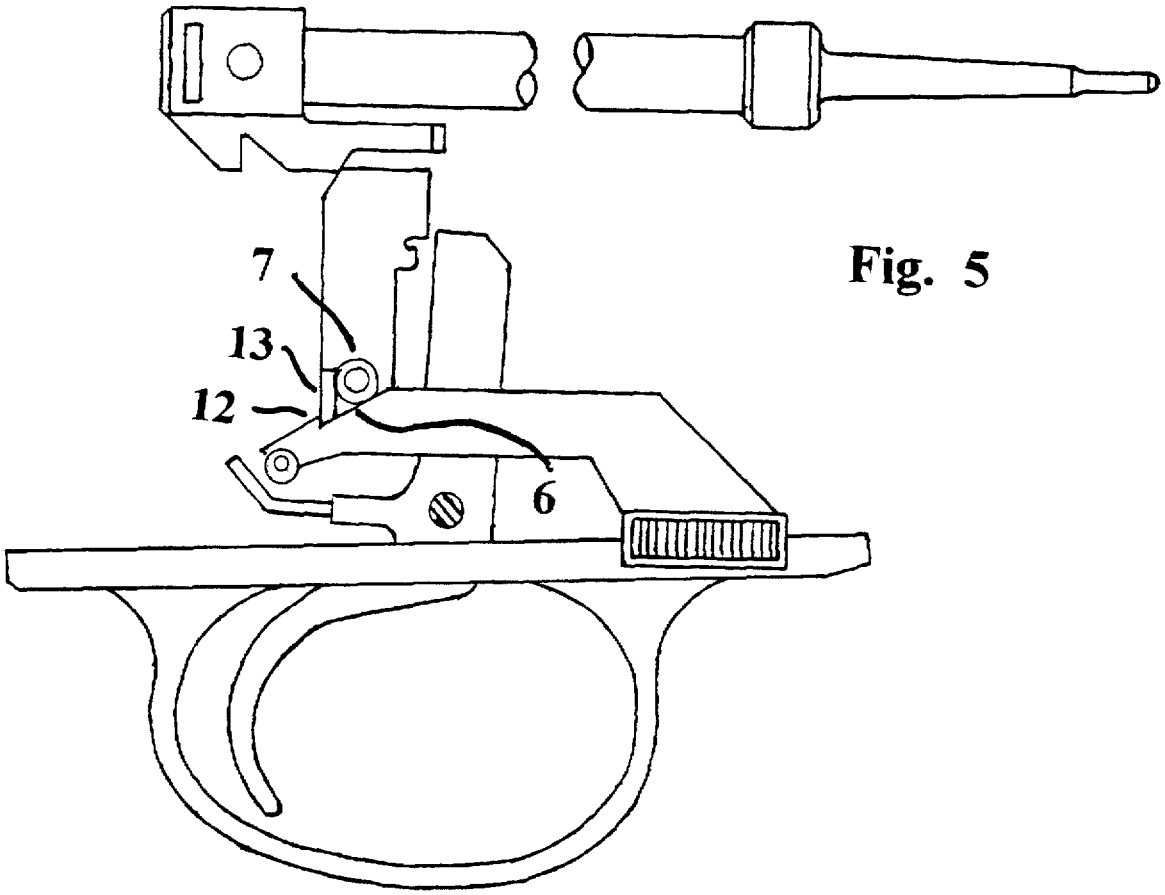

FIGS. 3 and 5, respectively, show the circumstances of the parts before and after an unsuccessful attempt to transfer the sear from the control of the safety mechanism to the control of the trigger piece. Since the trigger piece was not in a position to accept and support the sear, surfaces (6) and (7), on the safety mechanism and sear, respectively, have remained in contact, pressed against each other by pressure from the mainspring, as indicated in FIG. 5. Thus entrapping surfaces (12) and (13), on the safety mechanism and sear, respectively, engage and prevent further disengaging movement of the safety mechanism, blocking the complete release of the sear by the safety mechanism and the inadvertent discharge of the firearm.

The preceding description pertains to a fire control utilizing a vertically displaced sear, a safety mechanism which cams and blocks the sear, a backup trigger-immobilizing member, a symmetrically disposed finger lever means for adaptation to right or left-hand operation, and camming means employing low-friction elements. As will be understood by those skilled in the art, these and other specific details indicated in the preferred embodiment are not necessary to the present invention, which would be of equal value applied to other patterns of fire controls.

Figure 6:
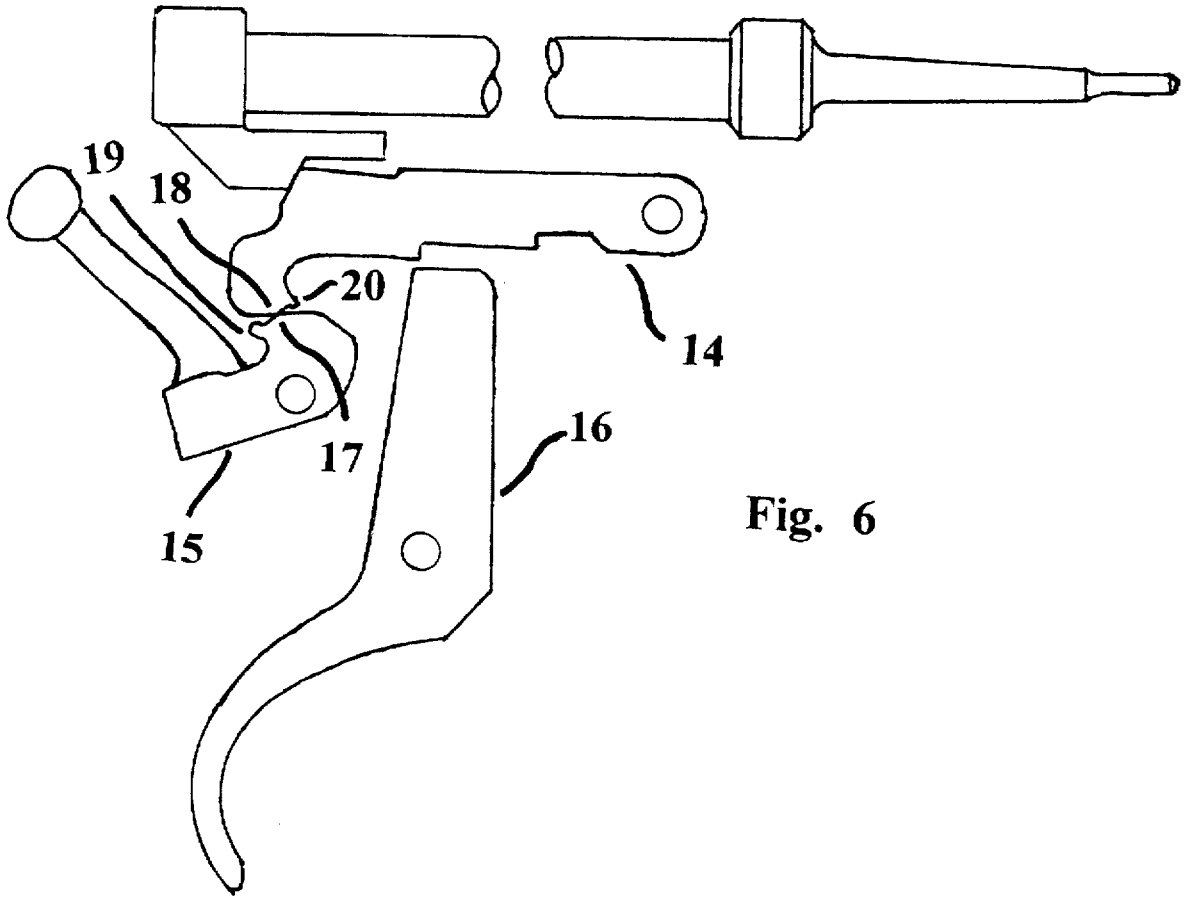
FIGS. 6 through 8 illustrate the function of the fail-safe backup means as embodied in a fire control with a pivoting sear and a thumb-operated safety mechanism which cams and blocks the sear.
Figure 7:
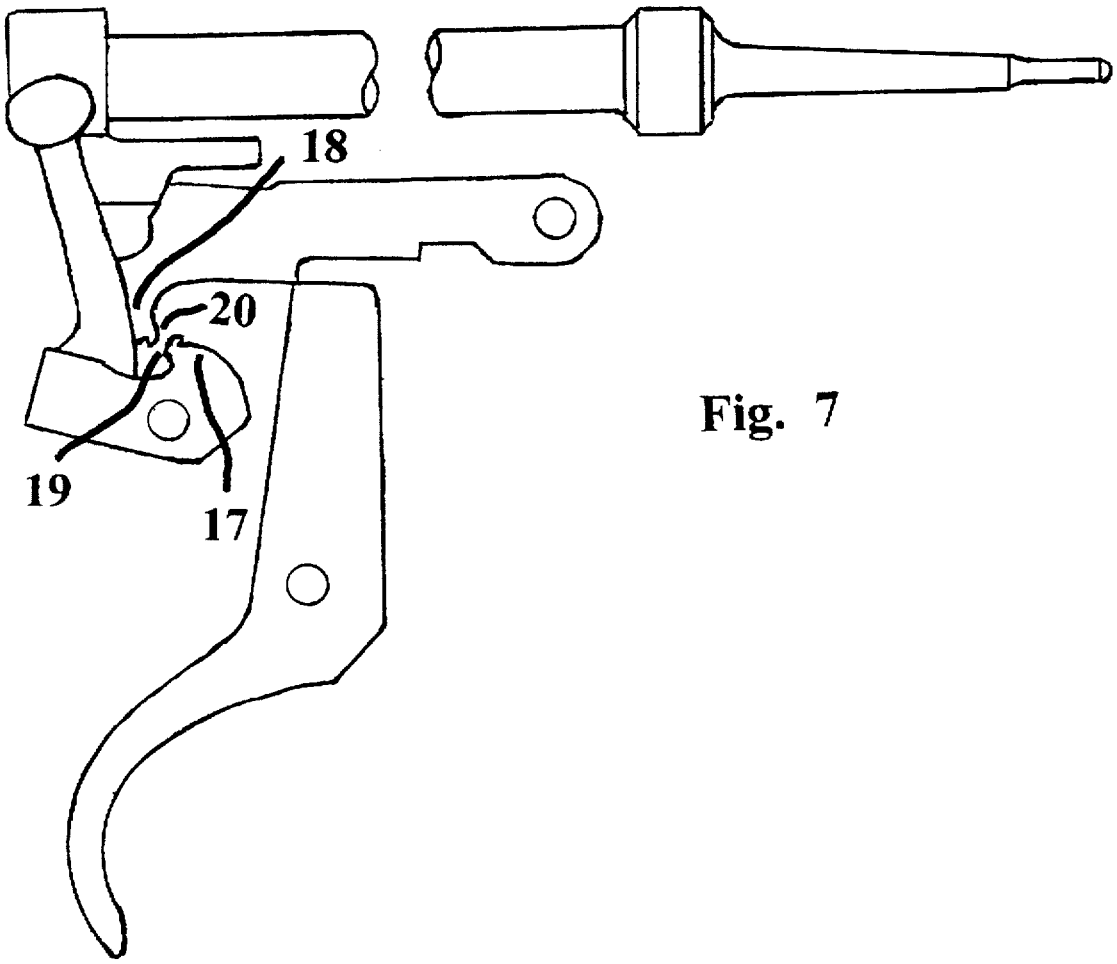
Figure 8:
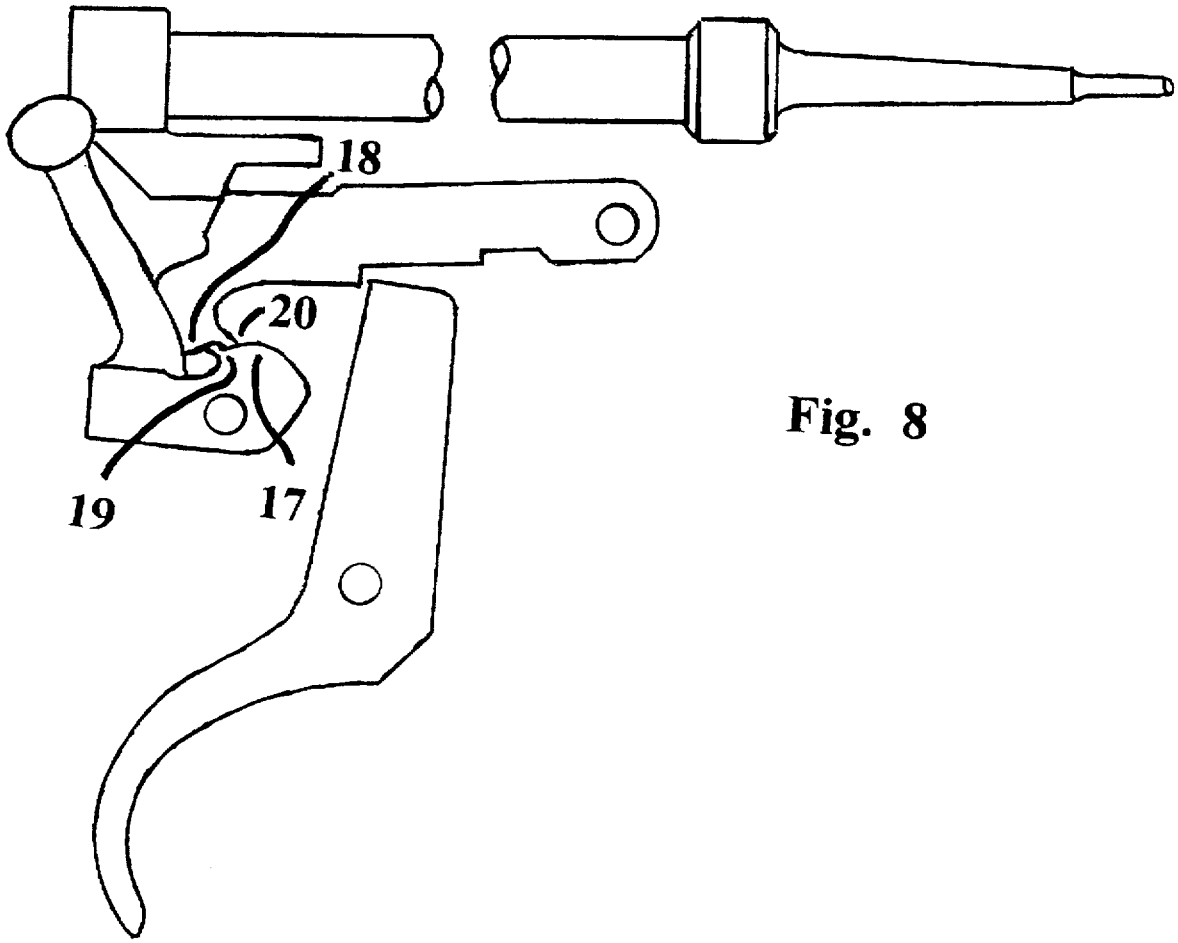

FIGS. 6 through 8 show the same functional principles and sequence of events as heretofore described, with an embodiment of the present invention applied to a sear and a thumb-actuated safety mechanism which operate by way of rotating movements rather than linearly sliding movements.

FIGS. 6 and 7, respectively, show the circumstances of the parts before and after the successful transfer of the sear (14) from the control of the safety mechanism (15) to the control of the trigger piece (16). After the trigger piece has picked up and arrested any further downward movement of the sear, surfaces (17) and (18), on the safety mechanism and sear, respectively, have immediately released contact and separated spatially during the remainder of the forward rotation of the safety mechanism as indicated in FIG. 7. Thus entrapping surfaces (19) and (20), on the safety mechanism and sear, respectively, do not engage and interfere with the complete release of the sear by the safety mechanism.

FIGS. 6 and 8, respectively, show the circumstances of the parts before and after an unsuccessful attempt to transfer the sear from the control of the safety mechanism to the control of the trigger piece. Since the trigger piece was not in a position to accept and support the sear, surfaces (17) and (18), on the safety mechanism and sear, respectively, have remained in contact, pressed against each other by pressure from the mainspring as indicated in FIG. 8. Thus entrapping surfaces (19) and (20), on the safety mechanism and sear, respectively, engage and prevent further disengaging rotation of the safety mechanism, blocking the complete release of the sear by the safety mechanism and the inadvertent discharge of the firearm.

Figure 9:
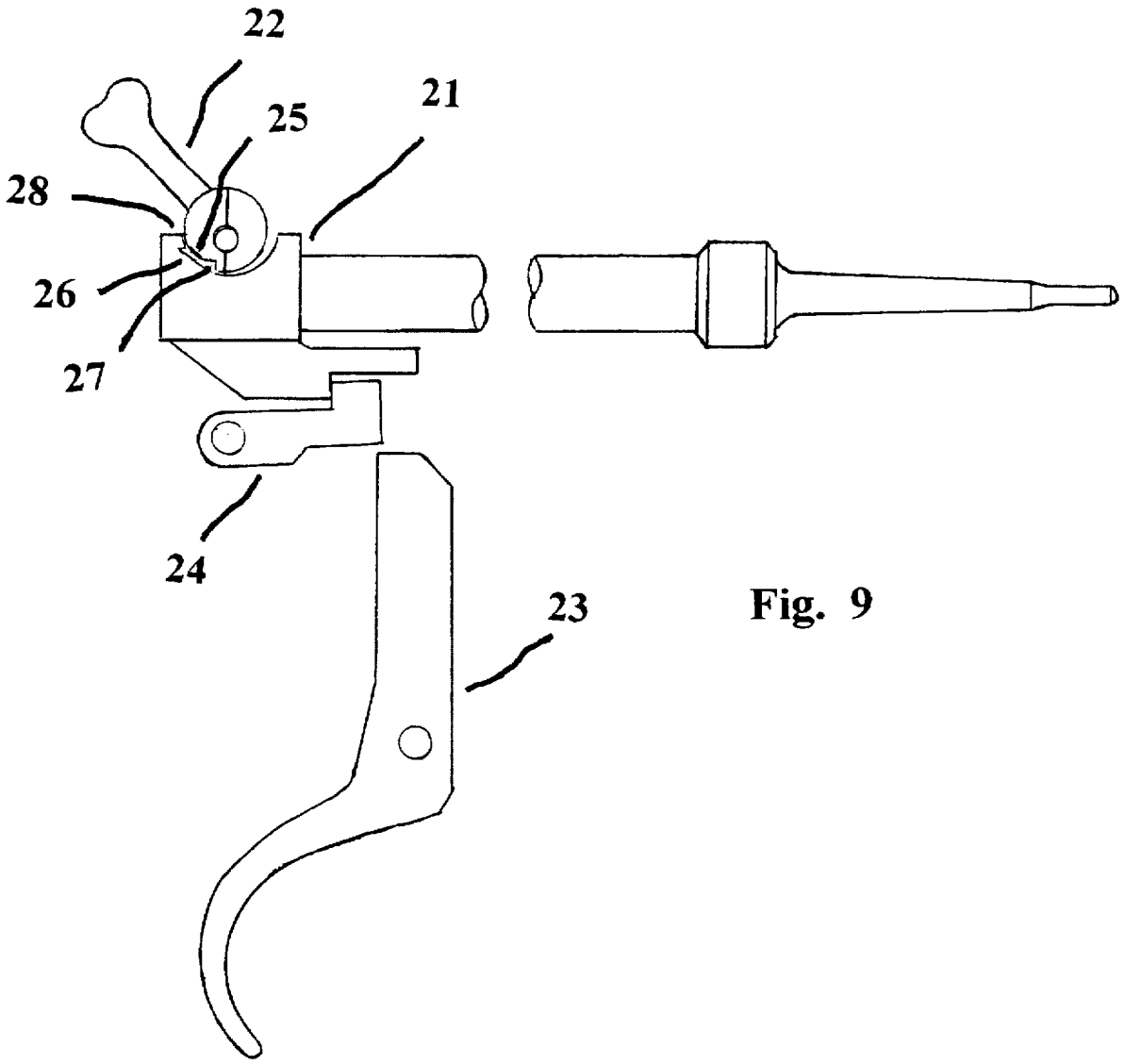
FIGS. 9 through 11 illustrate the function of the fail-safe backup means embodied in a fire control with a pivoting sear and a thumb-operated safety mechanism which cams and blocks the firing pin.
Figure 10:
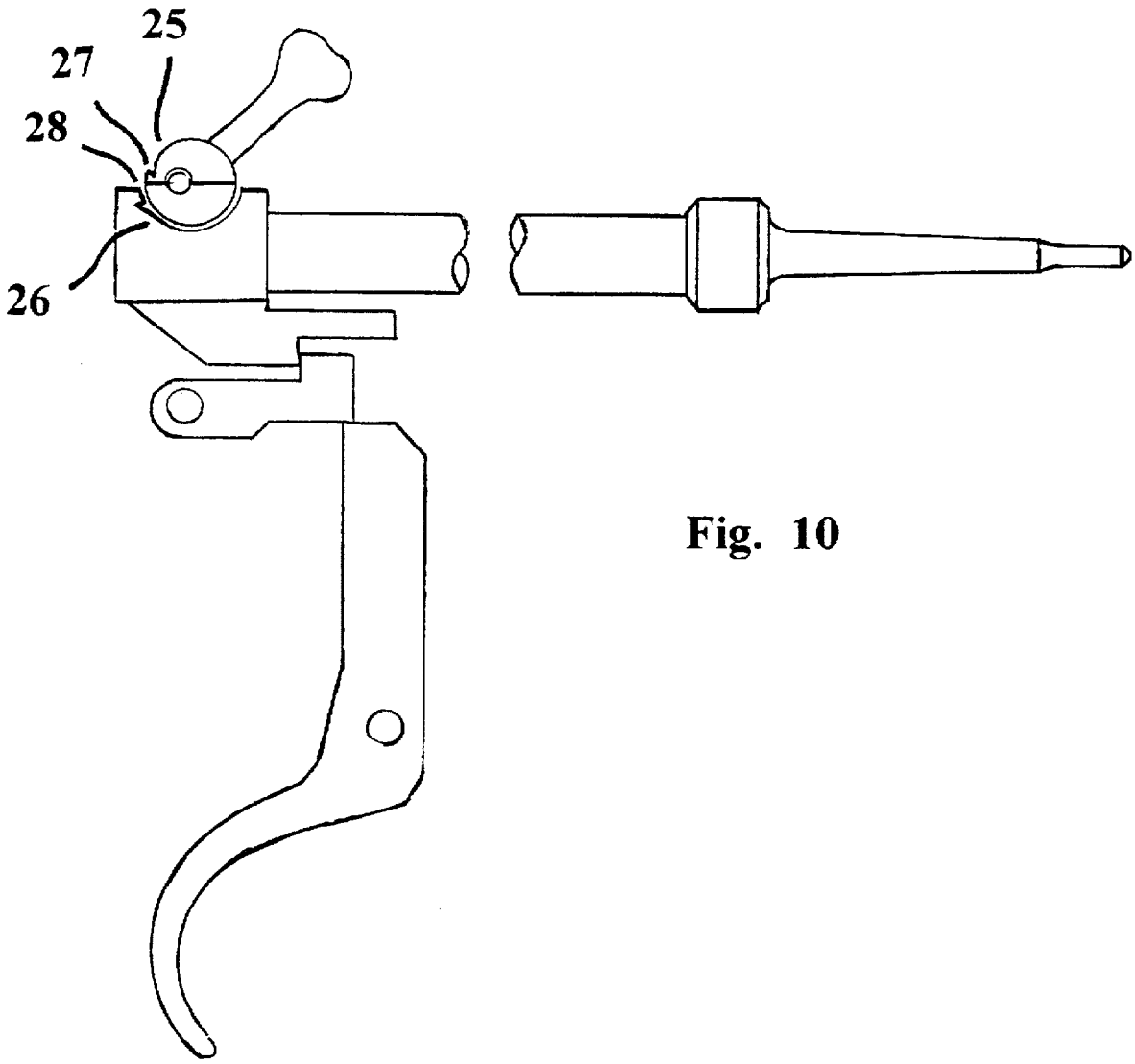
Figure 11:
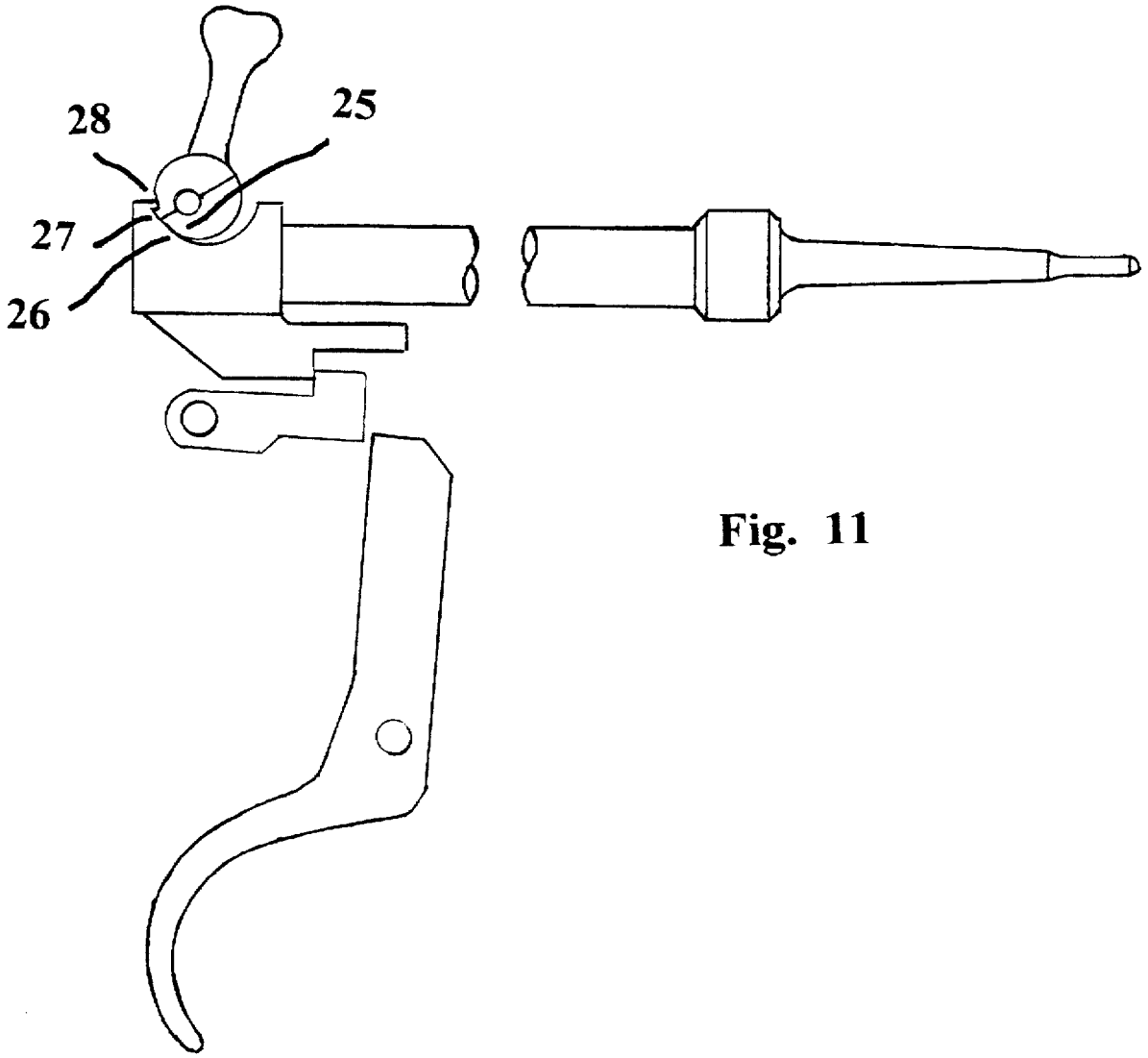

FIGS. 9 through 11 show the same functional principles and sequence of events with an embodiment of the present invention applied to a rotating sear and a thumb-actuated rotating firing-pin safety, comprising in this case a cam and block cylinder journalled eccentrically into a bolt sleeve (not shown) in a manner well known to those skilled in the art.

FIGS. 9 and 10, respectively, show the circumstances of the parts before and after the successful transfer of the firing pin (21) from the control of the safety mechanism (22) to the control of the trigger piece (23) by way of the sear (24). After the trigger piece has picked up and arrested any further downward movement of the sear, and in turn any forward movement of the firing pin, surfaces (25) and (26), on the safety mechanism and cocking piece, respectively, have immediately released contact and separated spatially during the remainder of the forward rotation of the safety mechanism as indicated in FIG. 10. Thus entrapping surfaces (27) and (28), on the safety mechanism and cocking piece, respectively, do not engage and interfere with the complete release of the sear by the safety mechanism.

FIGS. 9 and 11, respectively, show the circumstances of the parts before and after an unsuccessful attempt to transfer the firing pin from the control of the safety mechanism to the control of the trigger piece by way of the sear. Since the trigger piece was not in a position to accept and support the sear, surfaces (25) and (26), on the safety mechanism and cocking piece, respectively, have remained in contact, pressed against each other by pressure from the mainspring, as indicated in FIG. 11. Thus entrapping surfaces (27) and (28), in the safety mechanism and cocking piece, respectively, engage and prevent further disengaging movement of the safety mechanism, blocking the complete release of the firing pin by the safety mechanism and the inadvertent discharge of the firearm.

As will be obvious to those skilled in the art, the principles of the safety mechanism backup means can be equally applicable to the fire control of any firearm with a safety mechanism that cams and blocks the sear or the firing pin, not just the particular patterns selected for illustration in FIGS. 3 through 11.

The motion-entrapping means shown in FIGS. 3 through 11 are depicted as a hooking or saw-tooth type of surface configuration, however it will be appreciated by those skilled in the art that many different means of interrupting the movement of the safety mechanism could be utilized within the scope of this invention, including different surface configurations and even a shift in the geometry of the parts to eliminate adequate leverage for the completion of the disengaging movement.

A dimensional analysis will also show to those skilled in the art that the approach embodied in the present invention can operate in a far more certain and reliable manner than an approach which attempts to interrupt the disengaging motion of the safety mechanism based on the position of the trigger piece, because in a trigger mechanism capable of the satisfactory performance demanded by shooters today, only a relatively few thousandths of an inch of trigger piece movement differentiate a condition where the trigger piece is in proper position to provide support and where the trigger piece is not in proper position to provide support.

By operating upon the basis of the position of the sear, or the firing pin in a safety mechanism which cams and blocks the firing pin, a relatively large displacement is available, enough to easily ensure a safeguard system of complete certainty and reliability. To use typical numbers for a sear safety for the purpose of illustration, assume a fire control as depicted in FIGS. 6 through 8, and a vertical engagement between the sear and a suitably cooperating cocking piece above in the cocked or ready-to-fire condition of 0.100 inch. Further assume a vertical rise of the sear, when the safety mechanism is rotated counterclockwise to its fully engaged position, FIG. 6, of 0.025 inch. Thus with the safety fully engaged, a total vertical engagement of 0.125 inch is blocking the firing pin assembly from moving forward to discharge the firearm.

Upon moving the safety mechanism toward a condition of disengagement, after the sear has been lowered 0.025 inch the trigger piece will pick it up to block further downward movement, and the remainder of the disengaging movement of the safety mechanism will be free of any contact with the sear, FIG. 7.

But if for any reason the trigger piece fails to be in position to stop and support the sear, there is ample vertical movement over which the intercepting action of the present invention can occur. Assume the intercepting means is designed to begin engaging at a sear overtravel of 0.025 inch (i.e. when the sear has vertically dropped 0.025 inch below its normal perch on the trigger piece). Further assume the intercepting surfaces are fully engaged at a sear overtravel of 0.050 inch. That provides for an engagement of the intercepting surfaces of 0.025 inch and a remaining vertical engagement between the sear and the firing pin of 0.050 inch, more than adequate to positively prevent discharge in a properly designed and manufactured firearm.

Finally, it can be noted that this vertical displacement is not subject to any adjustments made within the fire control, as a fail-safe safety means directly based on the movement and position of the trigger piece might be. The same type of dimensional analysis would show the advantages when the safety mechanism backup is based on the horizontal displacement of the firing pin in a cam and block firing-pin safety configuration.

I claim:

1. In a firearm, a firing means, said firing means releaseably blocked by a trigger mechanism and a safety mechanism, said trigger mechanism having an actuating means operated by movement of the trigger finger in a direction parallel to the barrel bore to unblock the firing means, the improvement comprising a safety mechanism actuating means which operates by way of finger movement collinear with the finger movement employed to operate the trigger mechanism actuating means, the safety mechanism actuating means being located above and forward of the trigger mechanism actuating means and at a distance adjacent to the trigger mechanism actuating means which allows, without shifting from the preparation-to-fire handgrip on the firearm, the use of the same finger to operate both the trigger mechanism actuating means and the safety mechanism actuating means.

2. A firearm according to claim 1, wherein movement of the trigger mechanism is impeded, without free-play, in a non-rigid manner when the safety mechanism is moved to block the firing means.

3. A firearm according to claim 1, wherein a mechanical engaging means responding to trigger mechanism position ensures that movement of the safety mechanism to unblock the firing means can occur only when the trigger mechanism is in position to block the firing means.

* * * * *